US011387599B2

(12) United States Patent
Hiller

(10) Patent No.: US 11,387,599 B2
(45) Date of Patent: Jul. 12, 2022

(54) APPARATUS FOR CONNECTING A POWER CABLE

(71) Applicant: Metabowerke GmbH, Nuertingen (DE)

(72) Inventor: Matthias Hiller, Altenriet (DE)

(73) Assignee: Metabowerke GmbH, Nuertingen (DE)

( * ) Notice: Subject to any disclaimer, the term of this patent is extended or adjusted under 35 U.S.C. 154(b) by 38 days.

(21) Appl. No.: 17/118,955

(22) Filed: Dec. 11, 2020

(65) Prior Publication Data

US 2021/0184393 A1 Jun. 17, 2021

(30) Foreign Application Priority Data

Dec. 12, 2019 (DE) ..... 102019134135.3

(51) Int. Cl.
*H01R 13/52* (2006.01)
*H01R 13/58* (2006.01)

(52) U.S. Cl.
CPC ..... *H01R 13/5804* (2013.01); *H01R 13/5202* (2013.01); *H01R 13/5205* (2013.01); *H01R 13/5213* (2013.01)

(58) Field of Classification Search
CPC ..... H01R 13/5804; H01R 13/5202; H01R 13/5205; H01R 13/5213
See application file for complete search history.

(56) References Cited

U.S. PATENT DOCUMENTS

| | | | | |
|---|---|---|---|---|
| 9,356,379 | B2 * | 5/2016 | Jocham | H01R 13/4364 |
| 10,395,082 | B1 * | 8/2019 | Thompson | G06K 7/10881 |
| 2007/0190850 | A1 * | 8/2007 | Yamamoto | H01R 13/533 439/517 |
| 2016/0278225 | A1 * | 9/2016 | Gingrich, III | H01R 13/5213 |

FOREIGN PATENT DOCUMENTS

| | | | |
|---|---|---|---|
| DE | 10005989 | A1 | 8/2001 |
| DE | 102004051653 | A1 | 4/2006 |
| DE | 102005000162 | A1 | 5/2007 |
| DE | 102006022996 | A1 | 11/2007 |
| DE | 202016106821 | U1 | 3/2018 |
| EP | 2228179 | B1 | 8/2015 |
| EP | 2384855 | B1 | 6/2017 |

OTHER PUBLICATIONS

Deutsches Patent—Und Markenamt, "Office Action Issued in German Patent Application No. 10 2019 134 135.3", Nov. 25, 2020, p. 8, Published in: DE.

* cited by examiner

*Primary Examiner* — Tho D Ta
(74) *Attorney, Agent, or Firm* — Neugeboren O'Dowd PC

(57) ABSTRACT

The invention relates to an apparatus for connecting a power cable to an electronic unit of a power tool having at least one clamp for clamping a connecting line of the power cable and a contact element for establishing an electrical contact between the connecting line and the electronic unit. The clamp and the contact element are arranged on a connecting element extending through an opening in a housing element, which spatially separates the clamp from the electronic unit. The opening is sealed by a seal bearing against the connecting element.

10 Claims, 3 Drawing Sheets

APPARATUS FOR CONNECTING A POWER CABLE

This application claims priority to German Patent Application No. 10 2019 134 135.3 filed on Dec. 12, 2019, the entire contents of which are incorporated herein by reference for all proper purposes.

FIELD OF THE INVENTION

The present invention relates to an apparatus for connecting a power cable to an electronic unit of a power tool having at least one clamp for clamping a connecting line of the power cable.

BACKGROUND

DE 10 2006 022 996 A1 describes a known power cable.

DE 20 2016 106 821 U1 describes a mains connection system for a power tool that has a plug connection with a device socket and a device plug so that in the event of a defect in a mains cable, it can be easily replaced.

DE 10 2005 000 162 A1 (U.S. Pat. No. 7,320,620) describes a mains-operated hand-held tool with a housing from which a power cable extends to a power connection. The housing is provided with a mounting opening which can be closed by a mounting cover and through which connecting and fixing means can be moved out of the interior of the housing. The connecting means can be used to electrically connect cords of the power cable on the cable side with cords of a device wiring on the device side.

DE 100 05 989 A1 (EP 1 175 286 B1) describes a portable power tool which has a service lid in the area of the outlet opening of a power cable on a housing which is dimensioned in such a way that the power cable can be removed after opening it.

EP 2 384 855 B1 describes an angle grinder with a housing accommodating a motor and a switch block, which has a switch and a controller for controlling the motor.

From EP 2 228 179 B1, a power tool with a motor housing and a motor housed within the motor housing is known.

A manual electric machine-tool having a switch which has a coupling for detachably coupling the machine-tool mechanically and at the same time electrically with an electronic module is described in DE 10 2004 051 653 A1 (WO 2006/045657 A1).

When using power tools equipped with the above referenced power cables or with such devices for connecting the power cable to the electronic unit, the power cable may be damaged, for example, due to inattention, and must be replaced by a suitable service technician. Such an exchange or replacement of the power cable should be as simple as possible and should be carried out with as few tools and spare parts as possible. Furthermore, it should be ensured that the replacement of the power cable does not impair the dust resistance of the power tool. The solutions described above offer some approaches to this problem, but there is no satisfactory solution in practice.

It is therefore an object of the present invention to create an apparatus for connecting a power cable to an electronic unit of a power tool, which allows a simple exchange of a power cable without negatively affecting the basic properties of the power tool.

SUMMARY OF THE INVENTION

In accordance with one aspect of the present invention, an apparatus for connecting a power cable to an electronic unit of a power tool comprises at least one clamp adapted to connect a line of the power cable and a contact element adapted to establish an electrical connection between the line of the power cable and the electronic unit. The at least one clamp and the contact element are arranged on a connecting element extending through an opening in a housing element, wherein the housing element spatially separates the at least one clamp from the electronic unit.

DETAILED DESCRIPTION

Figure 1:
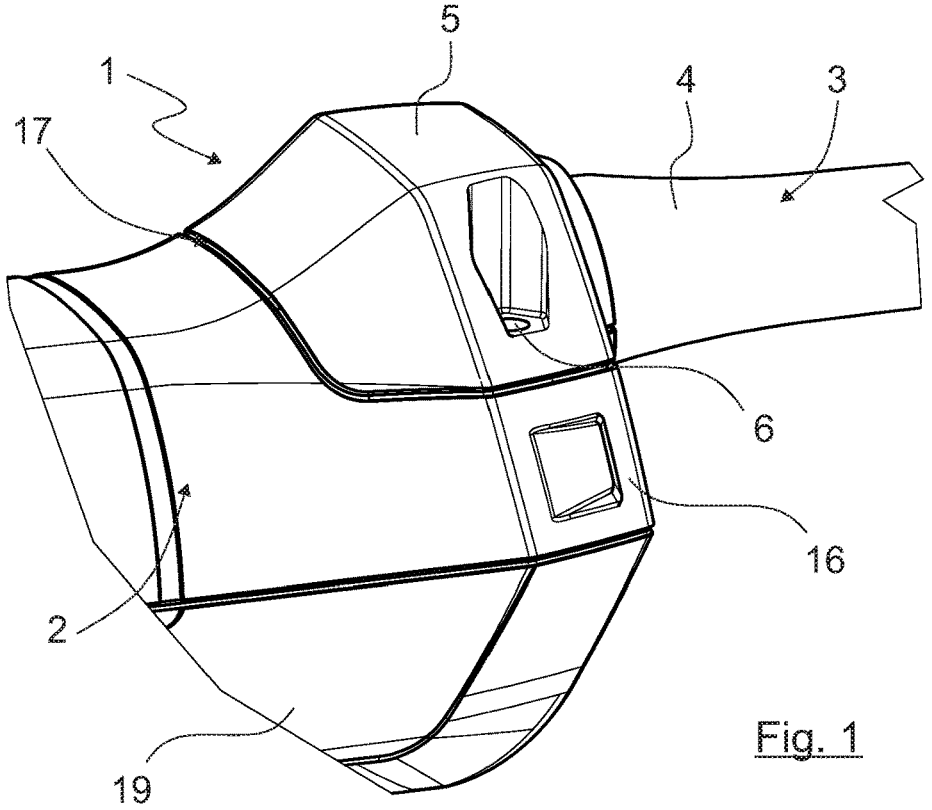
FIG. 1 shows a part of a power tool with a cover closing a cable exchange space.

A connecting element according to the invention creates a connection between the clamp and the contact element and thus ultimately between the connecting line and the electronic unit, which results in simple and safe contacting. The connecting element runs through an opening in a housing element which spatially separates the clamp from the electronic unit. The term "spatially separating" means that the housing element is located between the clamp, which serves to clamp the connecting line of the power cable, and the electronic unit, so that the clamp and the electronic unit are located in two different areas or rooms or spaces within one housing. A seal supports this spatial separation between the clamp and the electronic unit by sealing the opening used for the passage of the connecting element.

The housing element, in cooperation with the seal thus shields the electronic unit as well as the part of the contact element located in the area of the electronic unit from the clamp so that dust or other dirt possibly present in the area of the electronic unit cannot get into the area of the clamp. In this way, the service technician who changes the power cable has no access to the electronic unit, so that no damage or other negative impact on the electronic unit can occur when changing the power cable.

The device according to the invention is particularly, but not exclusively, suitable for power tools driven by a brushless electric motor, since changing the power cable is the most frequent service case for such power tools.

The fact that the opening is sealed by a seal that rests against the connecting element reliably prevents the penetration of dirt from the area where the electronic unit is located to the area where the connecting line is located.

A very simple and cost-effective design of the seal is achieved if it is formed in one piece with the housing element and has a considerably smaller wall thickness than the housing element.

If, in a further advantageous embodiment of the invention, the seal is formed as a sealing lip extending around or surrounding the opening of the housing element, a very simple and inexpensive but nevertheless reliable sealing effect between the clamp and the electronic unit is ensured.

In order to better separate the area where the power cable is exchanged or replaced from the other areas of the power tool, in particular from the electronic unit, it can also be provided that the housing element is formed at least partly as the bottom of a power cable exchange chamber.

If the power cable exchange chamber is closable by a removable cover, this will ensure a very good casing of the area where the power cable is connected and will also allow easy access to the power cable compartment by removing the cover.

The sealing of the power cable compartment can be improved if the cover can be sealed with respect to the housing element by a tongue-and-groove connection.

In a further advantageous embodiment of the invention, a strain relief device can be provided by means of which a sheathing of the power cable can be clamped. Such a strain relief device ensures that when a tensile force is applied to the power cable, no or only a very small force is applied to the connecting line, so that its connection to the clamp remains intact.

A very reliable contacting of the connecting line to the electronic unit via the clamp and the contact element is achieved, if the contact element comprises a metallic contact element.

Furthermore, it may be provided that two connecting elements with respective clamps and respective contacts are provided. This embodiment is advantageous for most common power tools.

Claim 10 specifies a power tool having a power cable, an electronic unit and an apparatus according to the present invention for connecting the power cable to the electronic unit.

In addition, it should be noted that terms such as "comprising", "have" or "with" do not exclude other features or steps. Furthermore, terms like "a/an" or "the", which refer to a single number of steps or features, do not exclude a plurality of features or steps and vice versa.

Further features and advantages of the invention result from the following description of an embodiment of the invention. The drawings show several features of the invention in combination with each other. Of course, the skilled person is also able to consider them separately and, if necessary, combine them into further meaningful sub-combinations without the necessity of an inventive step.

FIG. 1 shows a part of a power tool 1, in the present case an angle grinder. The power tool 1 has a housing 2, to which a power cable 3 for the electrical supply of the power tool 1 leads. FIG. 1 shows a sheathing 4 of the power cable 3 being arranged outside the housing 2 of power tool 1. Furthermore, the housing 2 of power tool 1 has a cover 5 which is screwed to the housing 2 and can be removed from the latter. The cover 5 is connected to the housing 2 by screws not shown here, which are passed through through-holes 6 in the cover 5.

Figure 2:
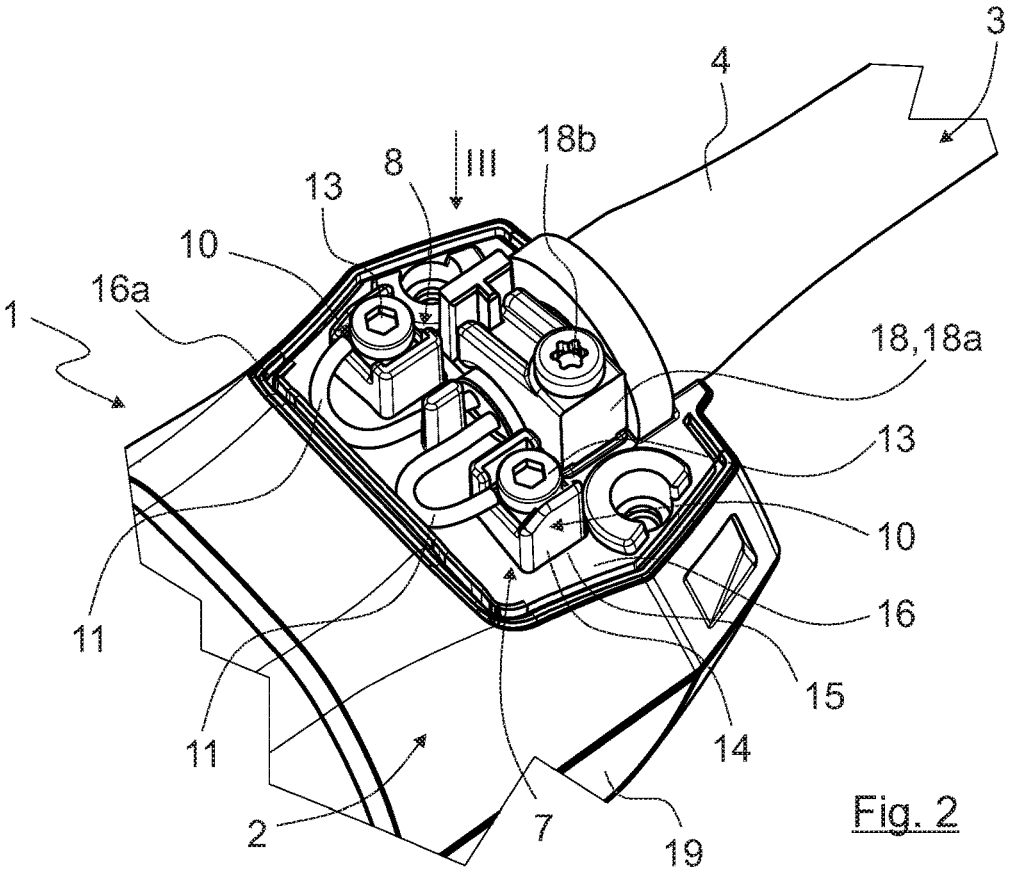
FIG. 2. is a view according to FIG. 1 with the cover removed.
Figure 3:
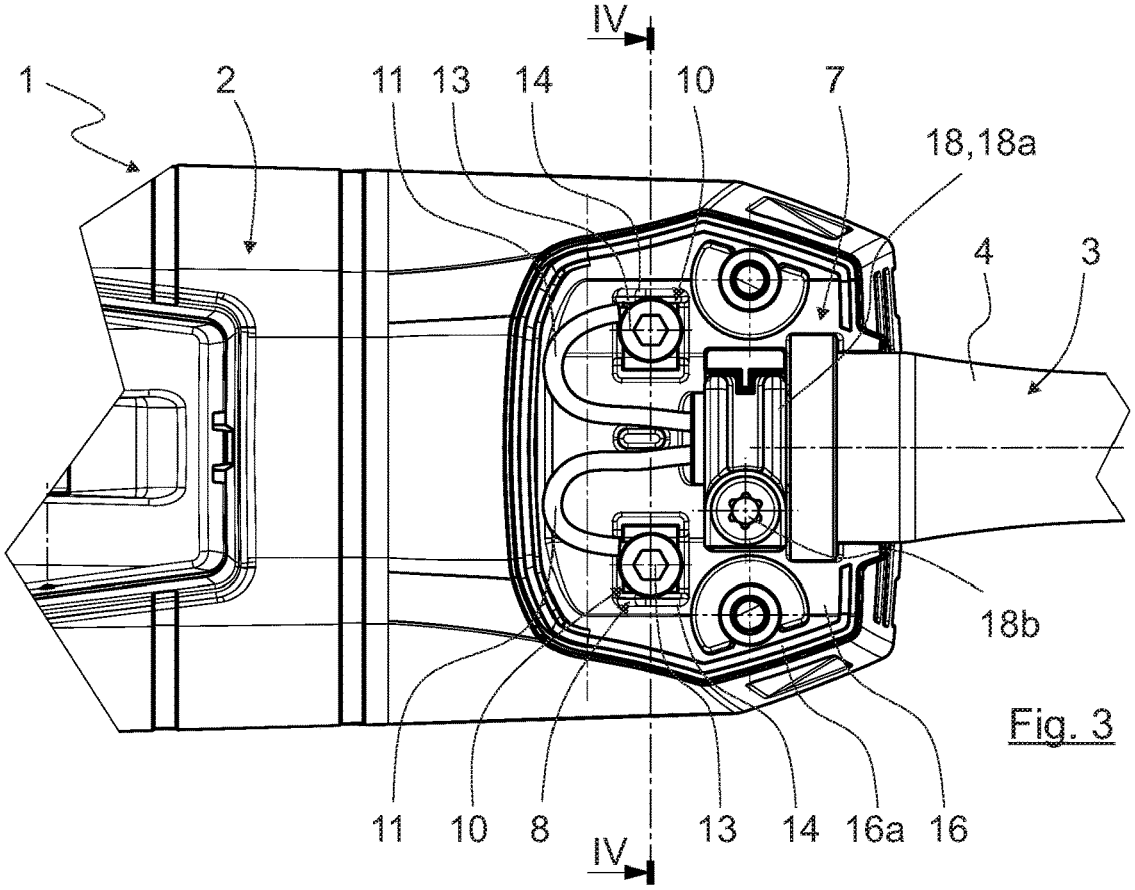
FIG. 3 is a top view according to arrow III of FIG. 2.
Figure 4:
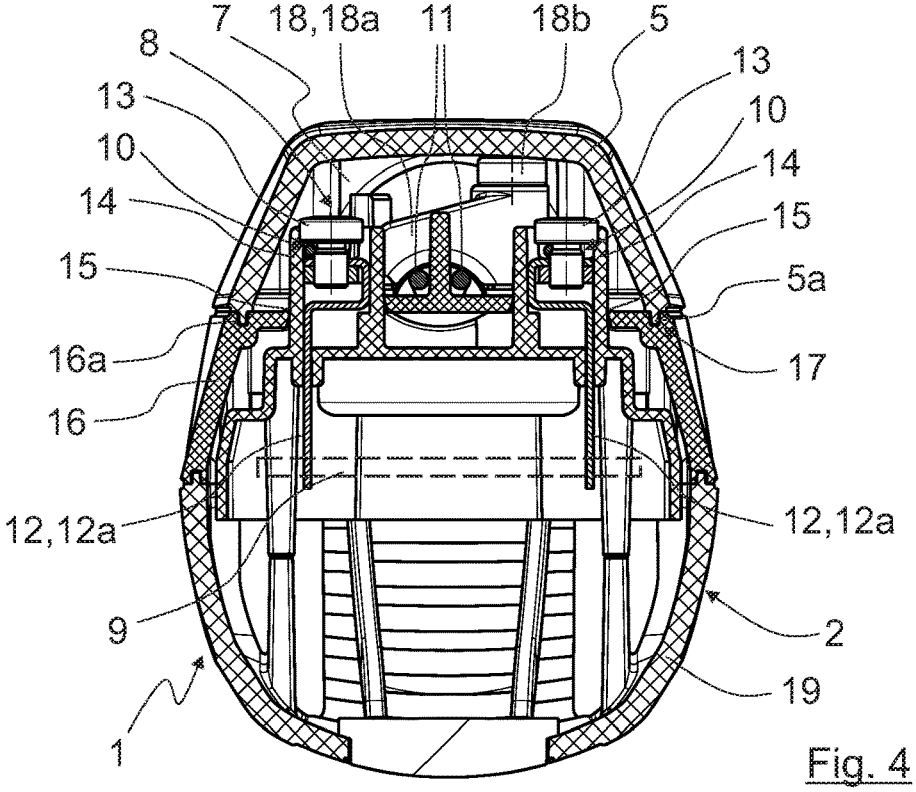
FIG. 4 is a section according to line IV-IV of FIG. 3.

FIG. 2 shows the part of power tool 1 shown in FIG. 1 without the cover 5. In addition to the housing 2 and the power cable 3, FIG. 2 shows a power cable exchange chamber 7 and an apparatus 8 for connecting the power cable 3 to an electronic unit 9 of power tool 1. The electronic unit 9 or a circuit board thereof is shown schematically in FIG. 4. In principle, the apparatus 8 described below can also be used for other power tools 1, although angle grinders are usually exposed to very high dust loads during operation. Apparatus 8 ensures that these dust loads do not have a negative impact on the operation of the power tool 1.

The apparatus 8 has at least one, in this case two clamps 10 for clamping the respective connecting lines 11 of the power cable 3 and a contact element 12 for establishing an electrical contact between the connecting line 11 clamped by the clamp 10 and the electronic unit 9. For clamping the connecting lines 11, the clamp 10 has respective screws 13 which engage in threads of the clamp 10 not shown. The contact element 12 has a metallic contact element 12*a*, which is in electrical contact with the connecting line 11 via the screw 13.

The clamp 10 and the contact element 12 are each individually arranged at a respective connecting element 14, which runs through a respective opening 15 in a housing element 16, which separates the clamp 10 from the contact element 12. In addition to the housing element 16 and the cover 5, the housing 2 also has a lower housing element 19, which forms the largest part of the housing 2. The connection between the housing element 16, which in this case can also be called the upper housing element 16, and the lower housing element 19 can be made in a known manner.

The housing element 16, through whose openings 15 the two connecting elements 14 run, is designed at least partly as the bottom of the power cable exchange chamber 7 or has a section forming the bottom of the power cable exchange chamber 7. While in the present case the bottom of the power cable exchange chamber 7 is designed in one piece with the housing element 16, it is also conceivable to design the bottom separately from the housing element 16, e.g., in the form of an insert, and to connect it firmly to the latter, e.g., by means of a tongue-and-groove connection. However, in order not to interfere with the sealing between the clamp 10 and the electronic unit 9 described in detail below, it is advantageous to design the bottom of the power cable exchange chamber 7 in one piece with the housing element 16 or to design the housing element 16 in such a way that it forms the bottom of the power cable exchange chamber 7, at least partly.

Thus, the housing element 16 or the bottom of the power cable exchange chamber 7 separates the clamp 10, to which the connecting lines 11 of the power cable 3 are connected, from the electronic unit 9 and from the area where the contact element 12 is connected to the electronic unit 9. The connecting elements 14 can also be called domes, as they protrude from the electronic unit 9 through the housing element 16 upwards into the power cable exchange chamber 7.

However, in principle it is possible that dirt, dust or the like can pass through the opening 15 from the area or room in which the electronic unit 9 is located to the area or room in which the clamp 10 is located, i.e. to the power cable exchange chamber 7.

Figure 5:
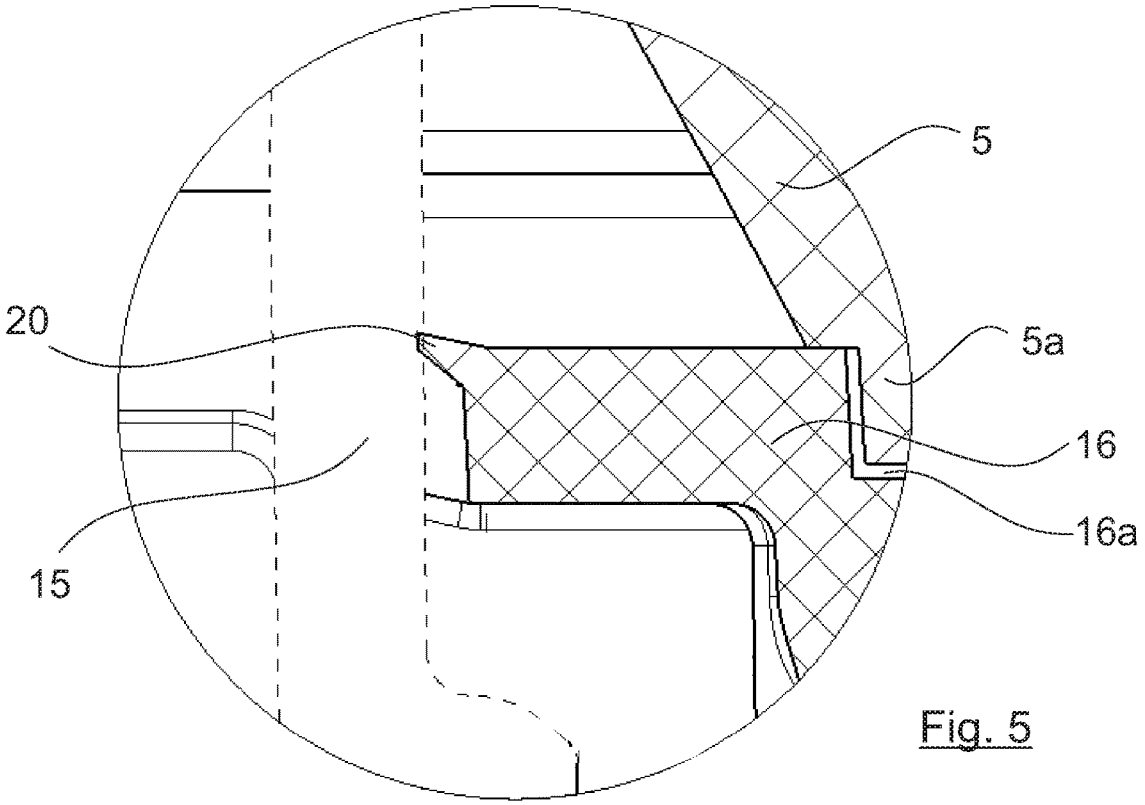
FIG. 5 is an enlarged view according to line V FIG. 4 in a first state.
Figure 6:
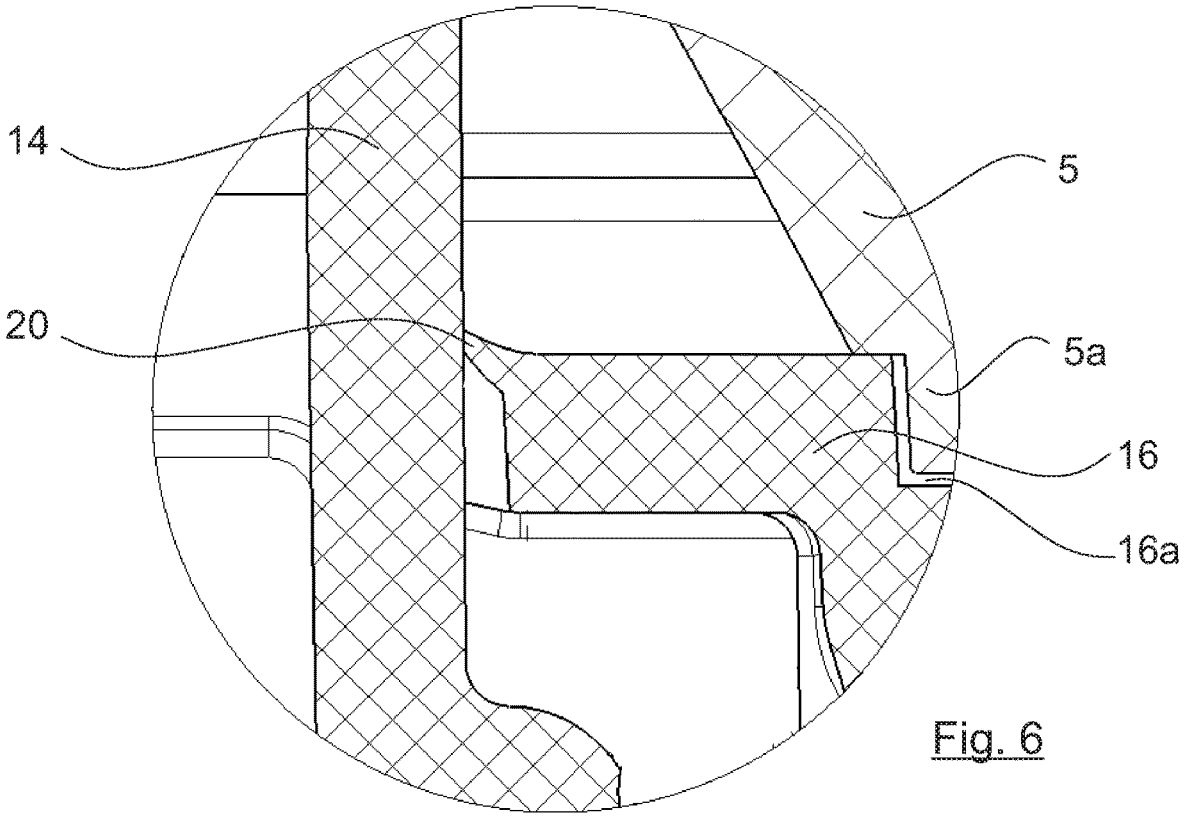
FIG. 6 is the representation of FIG. 5 in a second state.

In order to improve the sealing effect between the power cable exchange chamber 7 and the area where the electronic unit 9 is located, the opening 15 is sealed by means of a seal 20 resting against or abutting at the connecting element 14, as shown in FIGS. 5 and 6. In the present embodiment, the seal 20 is designed in one piece with the housing element 16 and has a considerably smaller wall thickness than the housing element 16. In this embodiment, the seal 20 is a sealing lip that runs or extends around the opening 15 of the housing element 16 through which the connecting element 14 is passed during assembly. This type of sealing lip can be injection-molded onto the housing element 16 during production of the housing element 16 and thus be formed in one piece with the housing element 16. The thin material of this sealing lip is displaced by the connecting element 14 during assembly, so that the seal 20 lies or rests against the connecting element 14 without a gap and seals the opening 15.

While FIG. 5 shows the seal 20 in its unloaded position, since the connecting element 14 (shown as a dashed line) is not yet in the opening 15, FIG. 6 shows the deformation of the seal 20 by the connecting element 14 inserted in the opening 15. The length of the seal 20 into the opening 15 should therefore preferably be selected so that the connecting element 14 and the seal 20 in contact with it provide a reliable seal of the opening 15.

While FIG. 5 and FIG. 6 show a version of the seal 20 in the form of a sealing lip, other versions of the seal 20 are also possible, by means of which a gap-free contact of the seal 20 with the connecting element 14 and thus a reliable sealing of the opening 15 can be guaranteed.

For example, very precise tolerances in the manufacture of the housing element 16 and in particular its openings 15 as well as in the manufacture of the connecting element 14 can produce a certain oversize of the connecting element 14 in relation to the opening 15, so that when the connecting element 14 is inserted into the opening 15, a sealing effect is created by the interaction of the respective, preferably elastic materials, for example suitable plastic materials, of the housing element 16 and the connecting element 14. Such a solution is also considered to be a seal 20, as it is able to seal the opening 15 in such a way that no dirt, dust or the like can get through the opening 15 from the area or room where the electronic unit 9 is located into the power cable exchange chamber 7.

Furthermore, it is possible to design the seal 20 and the housing element 16 in the form of a two-component version, in which, for example, the seal 20 is inserted into an injection mold by means of which the housing element 16 is manufactured. If necessary, the housing element 16 can have a groove into which the seal 20 is inserted in the form of a blank.

Another possibility is to arrange the seal 20 on the connecting element 14 so that the opening 15 is sealed when the connecting element 14 is inserted into it.

In order to prevent dust or dirt from outside from entering the power cable exchange chamber 7, the cover 5 is sealed against the housing element 16 by means of a tongue-and-groove connection 17. In this case, the housing element 16 has a groove 16*a* in which a tongue 5*a* of the cover 5 engages. The cover 5 does not have any air slits or similar, so that no dust can penetrate into the power cable exchange chamber 7.

Furthermore, a strain relief device 18 is provided in the power cable exchange chamber 7, which has a clamp 18*a* for clamping the sheathing 4 of the power cable 3 and a screw 18*b* for fastening the clamp 18*a*. The strain relief device 18 can be used to clamp the sheathing 4 of the power cable 3 so that a tensile force acting on the power cable 3 is absorbed by the strain relief device 18 and cannot loosen the connecting lines 11 clamped by the clamp 10.

The invention claimed is:

1. An apparatus for connecting a power cable to an electronic unit of a power tool, comprising:

at least one clamp adapted to connect a line of the power cable; and a contact element adapted to establish an electrical connection between the line of the power cable and the electronic unit, wherein the at least one clamp and the contact element are arranged on a connecting element extending through an opening in a housing element, wherein the housing element spatially separates the at least one clamp from the electronic unit, the opening being sealed by a sealing element resting against the connecting element.

2. The apparatus of claim 1, wherein the sealing element is formed in one piece with the housing element and has a smaller wall thickness than the housing element.

3. The apparatus of claim 2, wherein the sealing element is formed as a sealing lip extending around the opening of the housing element.

4. The apparatus of claim 1, wherein the housing element is formed at least partly as the bottom of a power cable exchange chamber.

5. The apparatus of claim 4, wherein the power cable exchange chamber includes a removable cover.

6. The apparatus of claim 5, wherein the removable cover can be sealed with respect to the housing element by a tongue-and-groove connection.

7. The apparatus of claim 1, further comprising a strain relief device with which a sheathing of the power cable can be clamped.

8. The apparatus of claim 1, wherein the contact element comprises a metallic contact element.

9. The apparatus of claim 1, wherein two connecting elements with respective clamps and respective contact elements are provided.

10. A power tool, comprising:

a power cable, an electronic unit; and a connecting device for connecting the power cable to the electronic unit, wherein the connecting device comprises, at least one clamp adapted to connect a line of the power cable; and a contact element adapted to establish an electrical connection between the line of the power cable and the electronic unit, wherein the at least one clamp and the contact element are arranged on a connecting element extending through an opening in a housing element, wherein the housing element spatially separates the at least one clamp from the electronic unit, the opening being sealed by a sealing element resting against the connecting element.

* * * * *